US005391138A

United States Patent [19]

Abramson et al.

[11] Patent Number: 5,391,138

[45] Date of Patent: Feb. 21, 1995

[54] SHEET FEEDING SYSTEM FOR A SHEET FOLDING APPARATUS

[75] Inventors: Richard J. Abramson, Glen Ellyn; Rudolf Retzl, Tinley Park, both of Ill.

[73] Assignee: The Hedman Company, Chicago, Ill.

[21] Appl. No.: 36,557

[22] Filed: Mar. 24, 1993

[51] Int. Cl.[6] ..... B65H 45/14

[52] U.S. Cl. ..... 493/421; 271/186; 271/273

[58] Field of Search ..... 493/418–421; 271/273, 186

[56] References Cited

U.S. PATENT DOCUMENTS

| | | | |
|---|---|---|---|
| 2,275,228 | 11/1955 | Seward | 493/419 |
| 2,589,436 | 3/1952 | Rouan et al. . | |
| 2,703,237 | 3/1955 | Rouan et al. . | |
| 2,706,115 | 4/1955 | Rouan et al. . | |
| 2,751,221 | 6/1956 | Hanson . | |
| 2,757,927 | 8/1956 | Bach | 493/421 |
| 2,766,040 | 10/1956 | Hanson et al. . | |
| 3,550,930 | 12/1970 | Brown . | |
| 3,616,069 | 10/1971 | Schwalbach | 493/418 |
| 4,023,790 | 5/1977 | Gortowski | 493/419 |
| 4,518,380 | 5/1985 | Shimizu et al. . | |
| 4,552,352 | 11/1985 | Nickels, Jr. | 271/273 |
| 4,573,672 | 3/1986 | Lehmann et al. . | |
| 4,586,704 | 5/1986 | Lehmann | 493/421 |
| 4,640,604 | 2/1987 | Kozuka | 271/273 |
| 4,834,699 | 5/1989 | Martin . | |
| 4,944,131 | 7/1990 | Gough . | |
| 5,000,432 | 3/1991 | Krasuski | 493/421 |
| 5,006,195 | 4/1991 | Martin et al. . | |
| 5,054,757 | 10/1991 | Martin et al. . | |

*Primary Examiner*—Jack W. Lavinder
*Attorney, Agent, or Firm*—Dressler, Goldsmith, Shore & Milnamow, Ltd.

[57] ABSTRACT

A sheet feeding system as provided for use in a buckle-type sheet folding apparatus which has sheet-receiving chutes and rollers for folding a sheet. The system includes a frame in which the sheet-receiving chutes are disposed and in which two of the rollers are rotatably mounted in parallel adjacent the chutes. A roller holder is removably mounted in the frame. An entrance roller and a coacting main roller are rotatably mounted in the holder parallel to the two rollers to define an intake nip.

12 Claims, 12 Drawing Sheets

176
32
30
130
127
153
138
132
129
44
172
170
134
118
124
294
250
180
178
38
152
154
156
150
120
116
71
96
73
72
104
74
76
158
159
208
74A
160
161
162
73A
140
4
4

Fig. 11
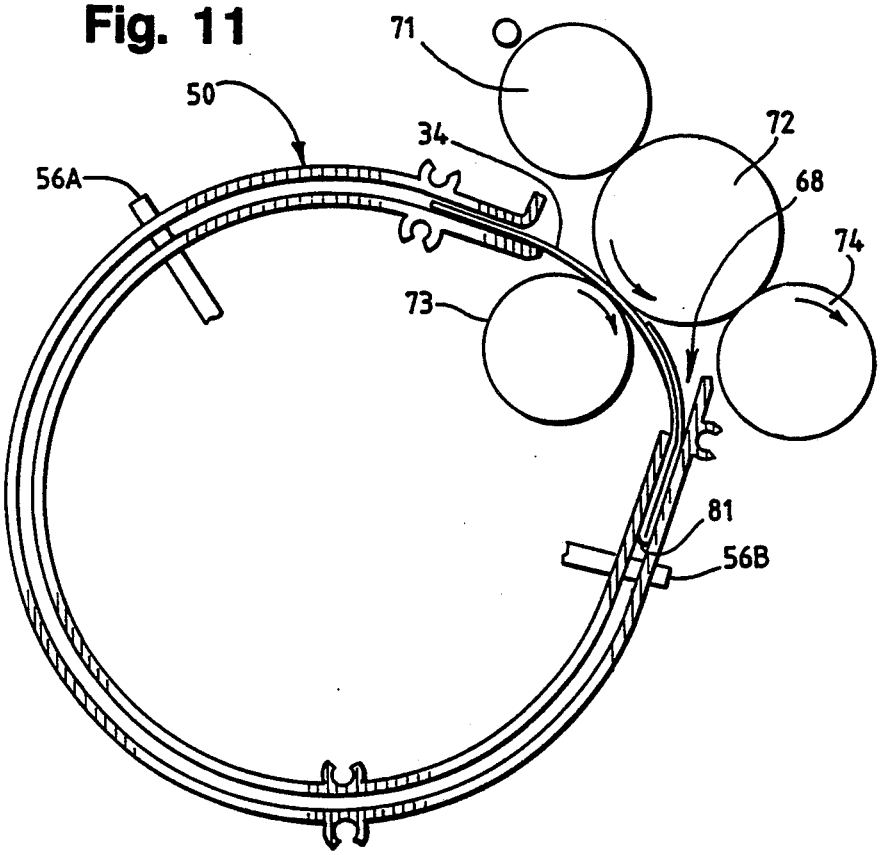
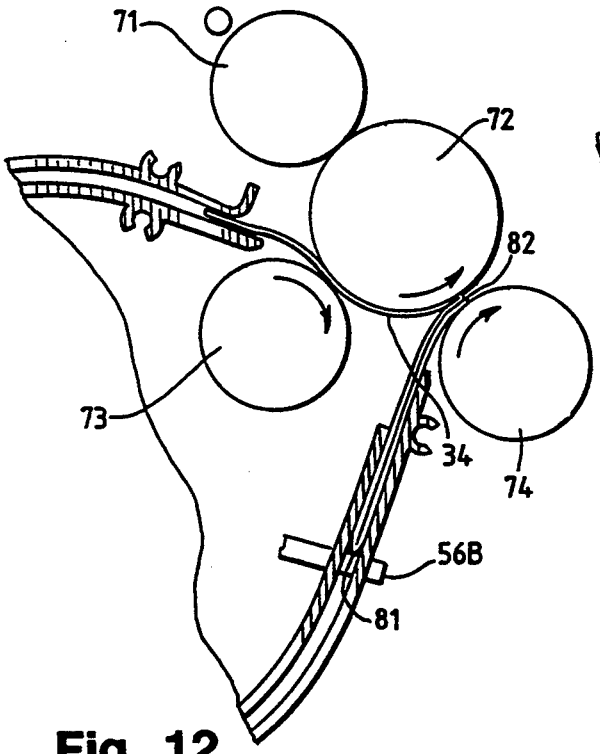
Fig. 12
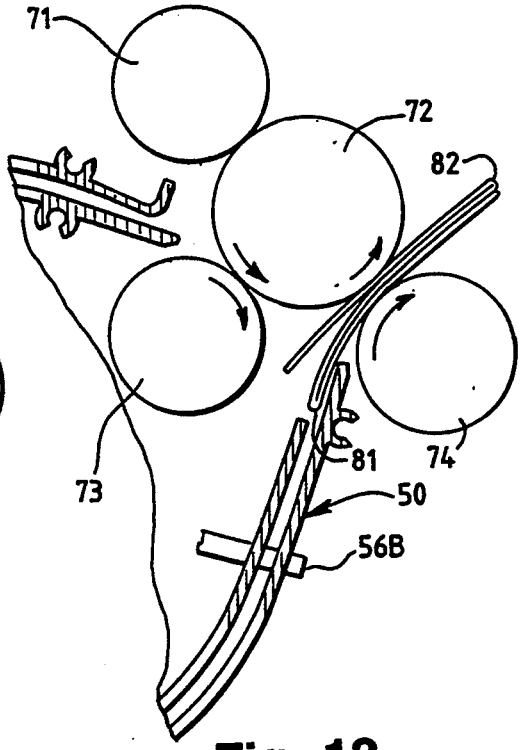
Fig. 13

SHEET FEEDING SYSTEM FOR A SHEET FOLDING APPARATUS

TECHNICAL FIELD

This invention relates to automated sheet folding machines, and more particularly to the type which employ rollers for transporting a sheet (e.g., a sheet of paper). In this type of machine the sheet is fed in one direction against a stop to buckle the sheet to form a first fold, and then the folded sheet is fed in a second direction to buckle the sheet to form a second fold as the double folded sheet is ejected from the machine.

BACKGROUND OF THE INVENTION AND TECHNICAL PROBLEMS POSED BY THE PRIOR ART

Conventional, buckle-type, paper sheet folding machines typically employ two sheet-receiving chutes or pockets and at least four cooperating rollers. The rollers define an arrangement of three pairs of coacting rollers through which a sheet is sequentially fed so as to convey the sheet into and out of the pockets to create two folds. Typical designs are disclosed in U.S. Pat. Nos. 2,751,221, 4,573,672, and 4,834,699.

While conventional paper folding machines may function generally satisfactorily, such machines must be properly operated and maintained. On occasion, a paper sheet may jam in a folding machine, and this can result from a number of factors. For example, the paper sheet may have had a pre-existing tear or the paper sheet may have been inserted or fed in an improper manner. In any event, the "jam" must be cleared. Typically, conventional machines require that the entrance pair of rollers be manually turned or cranked in a direction opposite to the normal rotation direction so as to "back out" the jammed paper.

In extreme cases, portions of the machine housing or some of the internal components may have to be removed by a technician to provide access to an interior part of the machine to permit removal of the jammed paper. Thus, it would be desirable to provide an improved roller system that would accommodate the more rapid and efficient clearing of paper jams.

In some cases, a conventional machine must be partially disassembled and the sheet-receiving pocket or pockets removed to facilitate clearing of the jammed paper. It would be advantageous to provide an improved design which would accommodate removal of some of the rollers to afford access to the pockets for jammed paper retrieval without requiring removal of the pockets. Such an improved system should preferably require only relatively simple operations which could be readily understood and performed by an ordinary office worker.

As a paper folding machine is used, particles of paper, as well as other dirt particles, may be deposited on the entrance rollers—especially on a knurled metal roller which is typically employed as one of the two rollers defining the entrance roller pair. Eventually the build up of such particulate matter must be removed to insure optimal machine performance. Accordingly, it would be desirable to provide an improved system for accommodating the cleaning of such rollers.

Also, over time, the operation of a paper folding machine results in wear of the components. Typically, one of the rollers of the entrance roller pair functions as a central roller which contacts the other three rollers.

This central roller is typically fabricated from a resilient, rubber or elastomeric material. This roller, being relatively soft, can wear more quickly and is more likely to be damaged during operation.

For example, when a multi-sheet, stapled letter is folded in the folding machines, the staple is pressed against the resilient material of the roller as the sheets pass through the nip of the entrance roller pair. The metal staple tends to be impressed into the resilient material of the rubber or elastomeric roller and cause a temporary deformation or indentation in the material. This subjects the material to a greater, localized pressure. Over time, the repeated pressure from staples can lead to the degradation of the surface finish of the material.

Also, occasionally a staple is not properly closed, and a sharp end of the staple may dig into the resilient material and tear or gouge the surface of the material. Eventually, the roller becomes so worn or damaged that the operation of the machine is deleteriously affected. It then becomes necessary or desirable to replace the resilient roller.

In many conventional paper folding machines, roller replacement is a somewhat involved task and may require the services of a technician. This, of course, usually requires scheduling of the service and shut down of the machine until it has been serviced and placed back into operation.

The repair, maintenance, and/or replacement of paper folding machine rollers causes undesirable inefficiencies and disruption of office work. The inventor of the present invention has recognized that it would be desirable to provide an improved roller mounting design which could facilitate maintenance and replacement of rollers by an ordinary office worker so that it would not be necessary to call in a trained technician.

Thus, it would be particularly beneficial if such an improved design could permit the complete removal of one or more rollers by the ordinary office worker in a simple and quick manner so as to facilitate removal of old rollers and installation of new rollers.

It would also be desirable to provide an improved mounting system for rollers in a manner that provides clear and easy access to the rollers for cleaning, as well as for facilitating removal and reinstallation. Preferably, such an improved system should permit removal, cleaning, and replacement of one or more rollers (e.g., an entrance roller pair) by the ordinary office worker without disassembly of other machine components and without the use of tools.

It would also be advantageous to provide an improved roller pair system which could accommodate different paper thicknesses as well as multiple sheets of paper.

Further, it would be desirable to provide such an improved roller system with a design that could accommodate incorporation of the system in a relatively small machine. In particular, it would be advantageous to provide the system with a configuration and size that could be accommodated in a relatively small, table top machine for use on an office desk or table.

Finally, it would also be beneficial if such an improved roller system in a small, paper folding apparatus could be incorporated in other paper-handling office machines such as xerographic machines. For example, the present invention contemplates employing an improved, small, paper folder apparatus at the output end of a xerographic machine for providing the user with folded copies. Preferably, such an improved paper folder apparatus in a xerographic machine would readily accommodate roller access, cleaning, removal, and replacement in a quick and simple manner by the ordinary office worker.

The present invention provides, among other things, an improved roller mounting system which can accommodate designs having the above-discussed benefits and features.

SUMMARY OF THE INVENTION

The present invention provides a novel sheet feeding system for use in a buckle-type sheet folding apparatus having sheet-receiving pockets or chutes and rollers for feeding a sheet. The system includes a roller pair which can be quickly and easily removed from the apparatus to facilitate maintenance. The system accommodates sheets of varying thickness and multiple sheet documents.

The system includes a frame in which sheet-receiving chutes are disposed and in which two of the apparatus rollers are rotatably mounted in parallel adjacent the chutes. A roller holder is removably mounted in the frame. A main roller and a coacting roller are rotatably mounted in the holder parallel to the other two rollers to define three roller pairs each presenting a nip through which said sheet is fed.

The holder, with the main roller and coacting roller mounted therein, can be easily removed as a single unit.

In a preferred form of the invention, a first biasing clamp engages the holder to urge the main roller against one of the other two rollers in the apparatus, and a second biasing clamp engages the holder to urge the main roller against the other of the two rollers in the apparatus.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIGS. 9–13 are simplified, diagrammatic, side elevational views of the components illustrated in FIG. 8 and show the sequential operation of the components to fold a sheet of paper twice in a Z-fold configuration;

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the paper folding machine of this invention is described in the normal (upright) operating position, and terms such as upper, lower, horizontal, etc., are used with reference to this position. It will be understood, however, that the paper folding machine of this invention may be manufactured, stored, transported, and sold in an orientation other than the position described.

Some of the figures illustrating an embodiment of the apparatus show structural details and mechanical elements that will be recognized by one skilled in the art. However, the detailed descriptions of some of these elements are not necessary to an understanding of the invention, and accordingly, are not herein presented.

Figure 1:
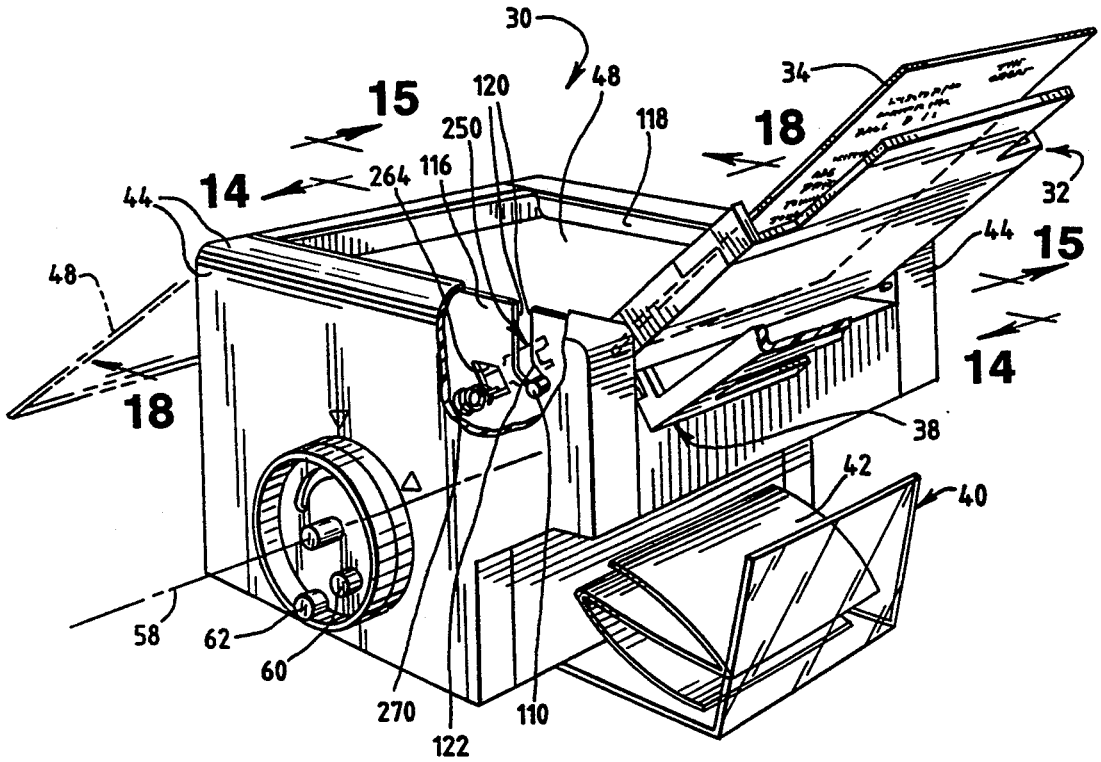
FIG. 1 is a perspective view of a sheet folding machine incorporating the sheet feeding system of the present invention.

A table top, sheet folding machine is illustrated in FIG. 1 and is designated generally therein by the reference numeral 30. The machine 30 is especially suitable for folding sheets of paper, such as correspondence or other materials which are typically sent through the mail in envelopes.

The machine 30 includes an upper, multiple sheet, stack loading feed tray 32 for automatically feeding paper sheets 34. A manual sheet feeding plate 38 is shown in an inoperative position below the tray 32. The stack loading feed tray 32 can be pivoted forwardly to a closed position on top of the machine 30 when not in use (FIG. 6) to permit the manual sheet feeding plate 38 to be pivoted forwardly over the top of the closed tray 32 to an operative position (FIG. 7) for accommodating manual feeding of sheets.

Below the plate 38 there is a discharge tray or collection tray 40 (FIG. 1) for collecting a stack of Z-folded sheets 42.

The machine 30 includes a pair of side housing portions or covers 44 which can be removed to provide access to the internal frame and mechanisms supported thereon. Also, the upper portion of the machine 30 includes a pivotally mounted cover 48 (FIG. 1) which is normally maintained in a horizontal position to cover underlying components in the machine. However, when access to those components is desired, the cover 48 can be pivoted upwardly (in the direction away from the feed tray 32) to the position shown in phantom by dashed lines in FIG. 1.

The machine 30 operates to fold a sheet in a well known manner. Briefly, as diagrammatically illustrated in FIG. 8, the machine includes a conventional buckle chute assembly 50 having an outer chute member 52 and an inner chute member 54 which is spaced from the outer chute member 52 to define a space or channel between the two members 52 and 54.

Two stop elements 56A and 56B, which may be of any suitable construction, are disposed in slots 57 defined by the chute members 52 and 54 to block the space between the members 52 and 54 at two locations. Preferably, each stop element 56A and 56B is movable within the slot to selected locations. As will become apparent from the following description, the location of each stop element 56A and 56B determines the location of the two folds in the sheet 34.

Preferably, the chute assembly 50 defines a major portion of a circle oriented about a central axis 58 (FIG. 8), and each chute member 52 and 54 defines a partially cylindrical cage. Each stop element 56A and 56B is carried on a carriage member (not illustrated) which is mounted to extend through the side of the machine for rotation relative to the central axis 58. The carriage members are each connected to one of two positioning knobs 60 and 62 (FIG. 1) on the exterior of the machine 30. The knobs 60 and 62 can each be moved in an arc about the axis 58 to, and locked at, a position where the associated stop element 56A or 56B is at a desired location within the chute assembly 50.

Figure 8:
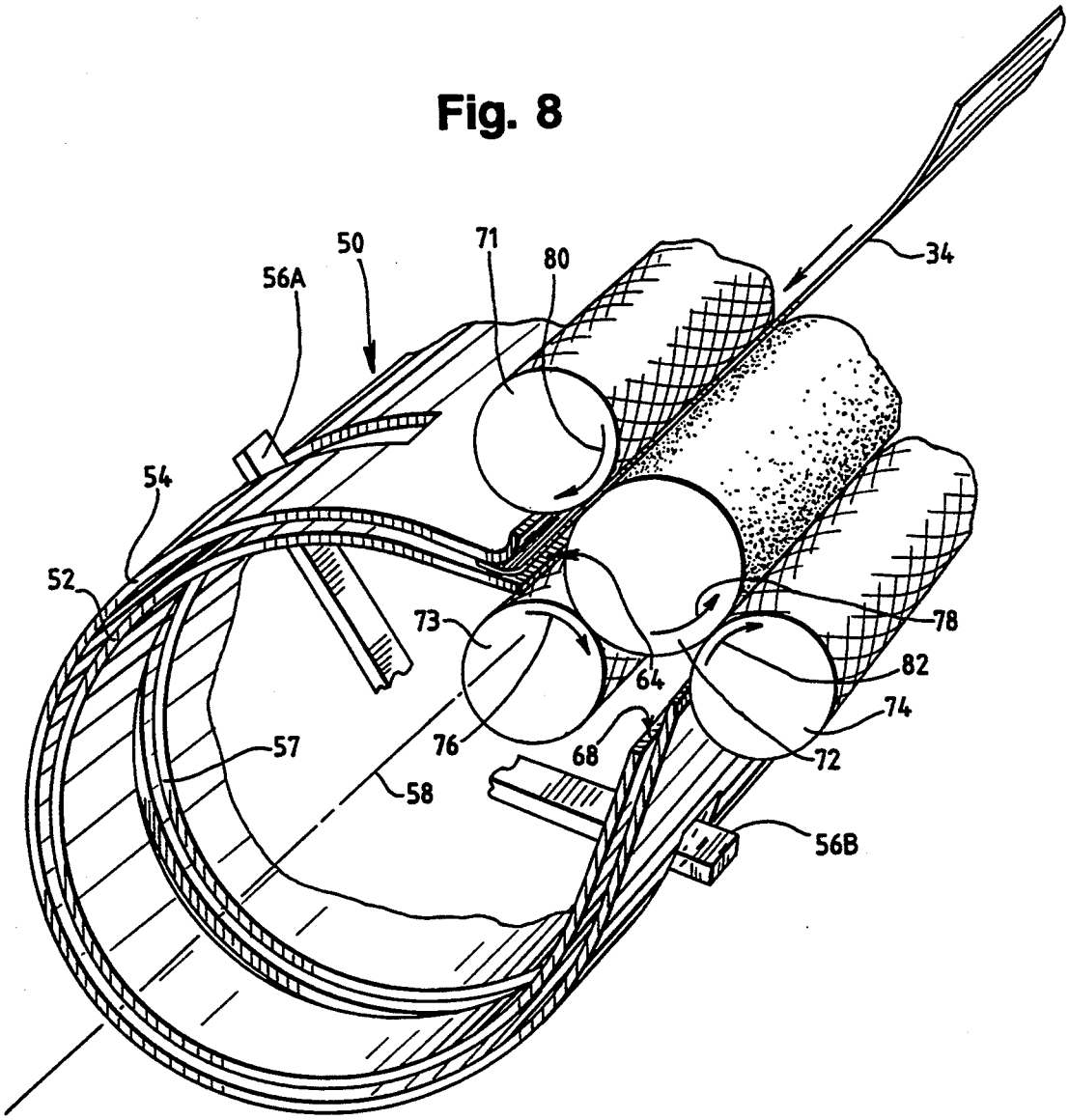
FIG. 8 (on the sheet of drawings with FIG. 1) is a greatly simplified, fragmentary, perspective view of the conveying rollers and sheet-receiving chutes shown receiving a paper sheet to illustrate the basic operation.

As illustrated in FIG. 8, the chute members 52 and 54 terminate at a roller receiving region where the members 52 and 54 define an inlet opening 64 on one side and define an opening 68 on the other side. The region between the chute members 52 and 54 extending from the inlet opening 64 to the stop element 56A is defined as a first buckle chute or pocket, and the region from the opening 68 to the stop element 56B is defined as a second buckle chute or pocket.

In some alternate designs, the chute assembly 50 need not have a partially cylindrical configuration and need not have two spaced-apart chute members 52 and 54. Rather, a first, single, sheet guide could be employed with a suitable stop element, and a second, single, sheet guide could be employed with another suitable stop element. Further, the stop elements 56A and 56B could be formed as a unitary or fixed part of a chute or pocket member. In any case, the detailed designs of the buckle chute or pocket structure and the associated stop elements form no part of the present invention.

Conventional, buckle-type sheet folding systems include a first, upper, entrance roller 71, a second, central, main roller 72, a third, side, interior roller 73, and a fourth or lower roller 74. The rollers are arranged in parallel (i.e., the rollers rotate about parallel axes). The rollers are arranged to define coacting pairs.

In particular, the first roller 71 and the second roller 72 form a first pair or entrance pair defining an intake nip for receiving a sheet 34 fed between the rollers 71 and 72 (FIG. 8). The second roller 72 and the third roller 73 form a coacting second pair to define a first fold nip between the two rollers. The second roller 72 and the fourth roller 74 together form a coacting third pair to define an second fold nip between the two rollers.

The third roller 73 is typically driven to rotate about its axis. As described in detail hereinafter, the fourth roller 74 in the present invention is driven through a gear system by roller 73. Rollers 71 and 72 are not directly driven, but instead each rotate in response to frictional engagement with an adjacent, rotating roller or by engagement with the sheet being conveyed between the rollers. Thus, when the third roller 73 is rotated (by suitable drive means described hereinafter) in the direction indicated by the arrow 76 in FIG. 8, the main roller 72 is frictionally engaged by the drive roller 73 to rotate in the opposite direction indicated by the arrow 78. The upper roller 71 is in turn driven by the main roller 72 to rotate in the direction indicated by the arrow 80. The fourth or lower roller 74 is driven through the gear system described hereinafter by the main roller 72 to rotate in the direction indicated by the arrow 82.

Figure 9:
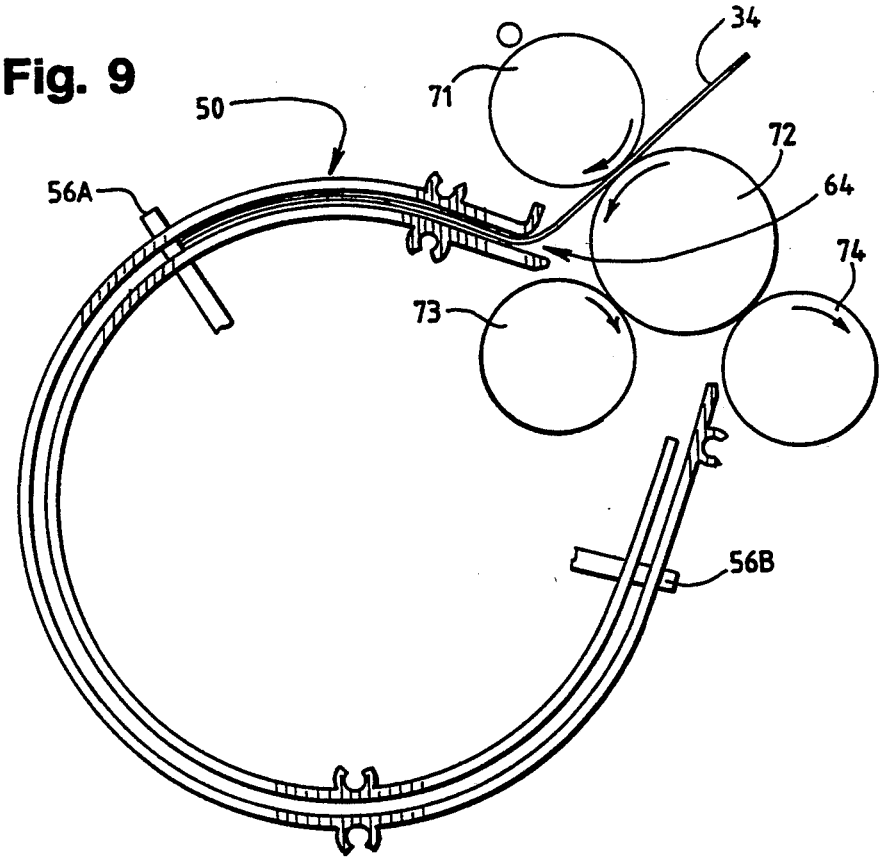
Figure 10:
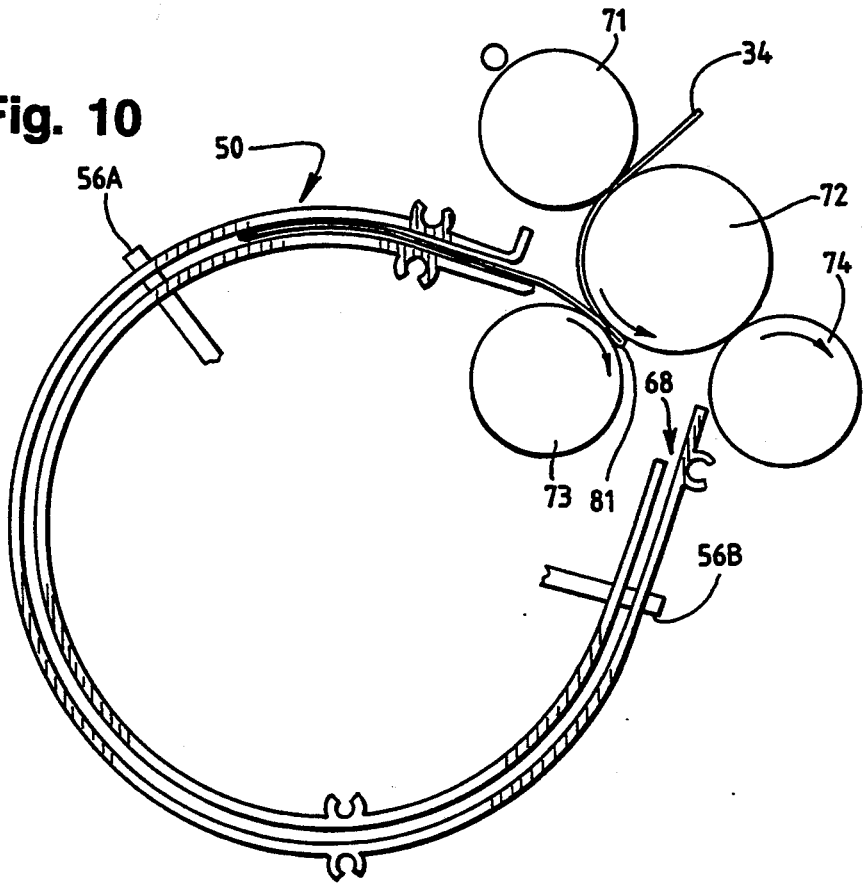

In conventional, buckle-type chute operation, the sheet 34 is fed through the nip defined by the entrance roller pair 71 and 72 as illustrated in FIG. 8, and the leading edge of the sheet 34 enters the opening 64 in the chute assembly 50. As illustrated in FIG. 9, the sheet 34 is conveyed along the chute assembly 50 until the leading edge abuts the stop element 56A. At this point, the forward movement of the sheet 34 terminates. However, the rollers 71 and 72 are still rotating to drive the rear portion of the sheet 34 toward the chute assembly 50. As illustrated in FIG. 10, this causes an intermediate portion of the sheet 34, between the chute assembly 50 and the rollers 71 and 72, to buckle rearwardly against the second pair of rollers 73 and 72. The buckled portion of the sheet 34 forms a first fold 81 which is drawn between the nip of the rollers 73 and 72.

As illustrated in FIG. 11, the first fold 81 then defines a leading edge as the sheet 34 is conveyed into the opening 68 of the chute assembly 50. When the first fold 81 abuts the stop element 56B as illustrated in FIG. 12, the sheet 34 buckles again rearwardly toward the third pair of rollers 72 and 74 to define a second fold 82. The sheet 34 is drawn through the nip of the rollers 72 and 74 with two folds defining three layers having a generally Z-shaped fold configuration (FIG. 13). The folded sheet 34 is then discharged from the machine 30 to the receiving tray 40 on top of any previously folded and discharged sheet 42 (FIG. 1).

It will be appreciated that the location of the folds 81 and 82 in the sheet 34 can be varied by changing the position of the stop elements 56A and 56B within the chute assembly 50. The above-described buckle-type, sheet folding process is conventional and can be operated at a relatively high processing speed so as to sequentially fold a large number of sheets relatively quickly. However, during the operation of a buckle-type, sheet folding machine, a sheet may jam in the machine. Then, with some conventional machines, the entrance pair of rollers must be manually turned or cranked in a direction opposite to the normal rotation so as to "back out" the jammed paper. In extreme cases, portions of the conventional machine, or some of the internal components, may have to be removed by a technician to provide access to an interior part of the machine to permit removal of the jammed paper.

Further, dirt particles may be deposited upon the rollers or other parts of the machine. Eventually the build up of such particulate matter must be removed to ensure optimal machine performance. This typically requires the removal of one or more of the rollers.

Also, over a period of time, one or more of the rollers may wear and have to be replaced. Typically, the main roller 72 (FIG. 8) is more likely to wear and require replacement because it is conventionally fabricated from a resilient, rubber or elastomeric material. This roller, being relatively soft, can wear more quickly and is more likely to be damaged during operation.

According to the present invention, an improved sheet feeding system is provided to permit the complete removal of a roller pair in a simple and quick manner so as to facilitate removal of jammed paper, cleaning of the rollers, replacement of the rollers, etc. In the preferred embodiment, the entrance roller pair is removable.

Figure 17:
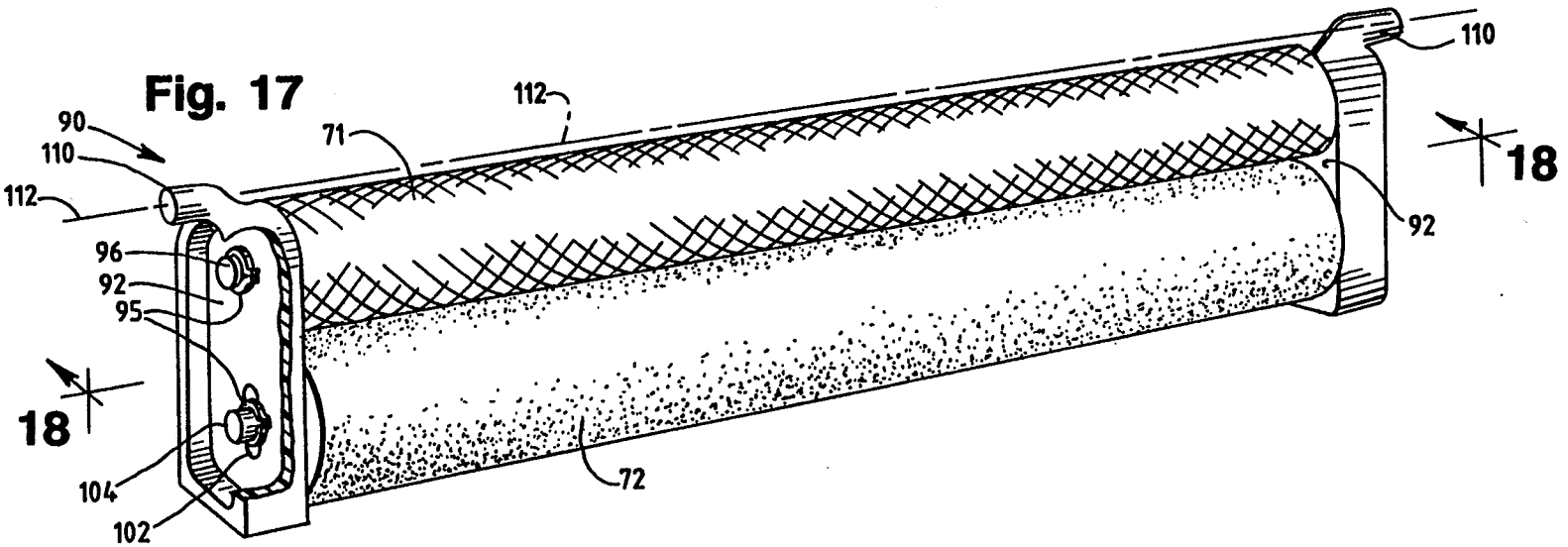
FIG. 17 is a greatly enlarged, perspective view of the entrance roller pair assembly or cartridge.
Figure 18:
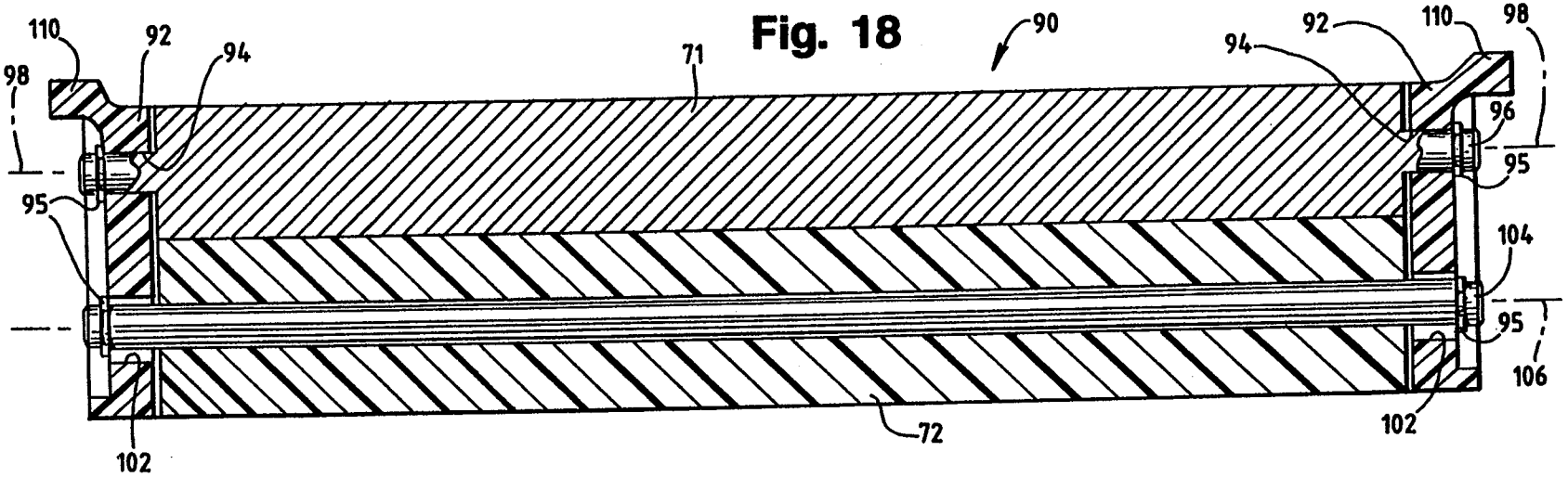
FIG. 18 is a cross-sectional view taken generally along the plane 18—18 in FIG. 17.

To this end, the entrance pair of rollers 71 and 72 are provided in a unique, removable assembly or cartridge 90 as illustrated in FIG. 17. The assembly includes a roller holder having two, spaced-apart end walls 92 which are typically molded from a suitable synthetic, thermoplastic polymer. As illustrated in FIG. 18, each end wall 92 defines a bore 94 axially aligned with the other bore 94. The entrance roller 71 includes a central shaft 96 projecting outwardly at each end for being received in one of the bores 94 to define a rotational axis 98 which is fixed relative to the holder end walls 92. The roller 71 is releasably mounted in the end walls 92 by means of conventional retainer clips 95.

Each end wall 92 of the roller holder also defines an elongate slot 102 aligned with the other elongate slot. The main roller 72 includes a central shaft 104 which projects outwardly at each end for being received in one of the slots 102. A conventional retainer clip 95 is provided at each end for retaining the main roller 72 between the holder end walls 92.

FIG. 18 shows the main roller 72 contacting the entrance roller 71. In this position, the main roller shaft 104 is located within each end wall slot 102 so that there is some clearance above and below the shaft 104. The main roller 72 can thus be moved outwardly away from the entrance roller 71 a small amount to provide a variable clearance between the two rollers for purposes described in detail hereinafter.

At the top of each end wall 92 there is an outwardly projecting stub shaft 110, and each stub shaft 110 is adapted to be received in a slot in the machine frame as described in detail hereinafter. Each stub shaft 110 is generally cylindrical and defines a common axis 112. The axis 112 is parallel to the rotational axis 98 defined by the shaft 96 of the roller 71 and is also parallel to the axis 106 defined by the shaft 104 of the main roller 72.

In a preferred embodiment of the present invention, the entrance roller 71 is metal, or at least has a metal exterior which defines a toothed or knurled surface. The third roller 73 and fourth roller 74 are each also typically fabricated from metal and they each have a toothed or knurled surface. Preferably, the three rollers are fabricated from aluminum.

On the other hand, the main roller 72 preferably includes a resilient material, such as a rubber or elastomeric material, around the shaft 104. Thus, hard particles, or other elements such as staples, which maybe carried in the sheet 34, will pass relatively easily between the nips of the rollers owing to the temporary deformation or indentation that will be formed in the resilient material of the main roller 72.

The above-described removable, dual roller assembly or cartridge 90 of the present invention is adapted to be mounted in the machine 30 below the movable cover 48 (FIGS. 1 and 2) at the bottom of the tray 32 between a frame side wall 116 (FIGS. 1 and 2) and a frame side wall 118 (FIGS. 1, 2 and 4–16). The frame side wall 116 defines a slot having a vertical, upper portion 120 and a lower portion 122 extending at an oblique angle relative to the upper portion 120 as shown in FIG. 1. The other frame side member 118 (FIGS. 14 and 15) has a matching slot defining a vertical, upper portion 124 and a lower portion 126 extending at an oblique angle from the bottom of the upper portion 124.

Figure 14:
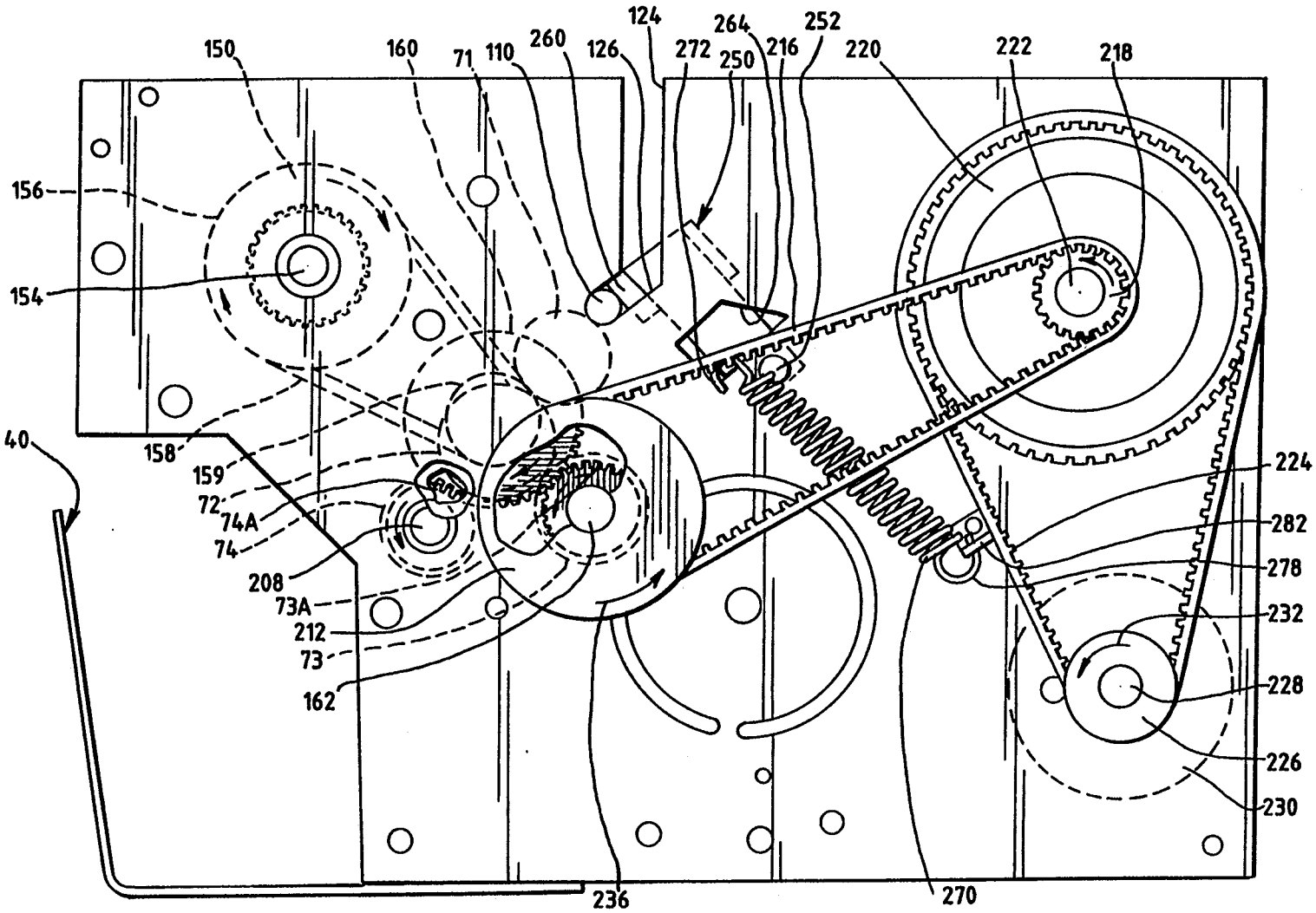
FIG. 14 is an enlarged, side elevational view of the machine taken along the plane 14—14 in FIG. 1 with the side housing removed to illustrate interior detail.

As shown in FIGS. 1 and 14, the stub shafts 110 at the top of the dual roller cartridge assembly 90 are each received in one of the slots. Each stub shaft 110 is adapted to be moved down the slot upper portion 120 or 124 into the lower portion 122 or 126.

Figure 15:
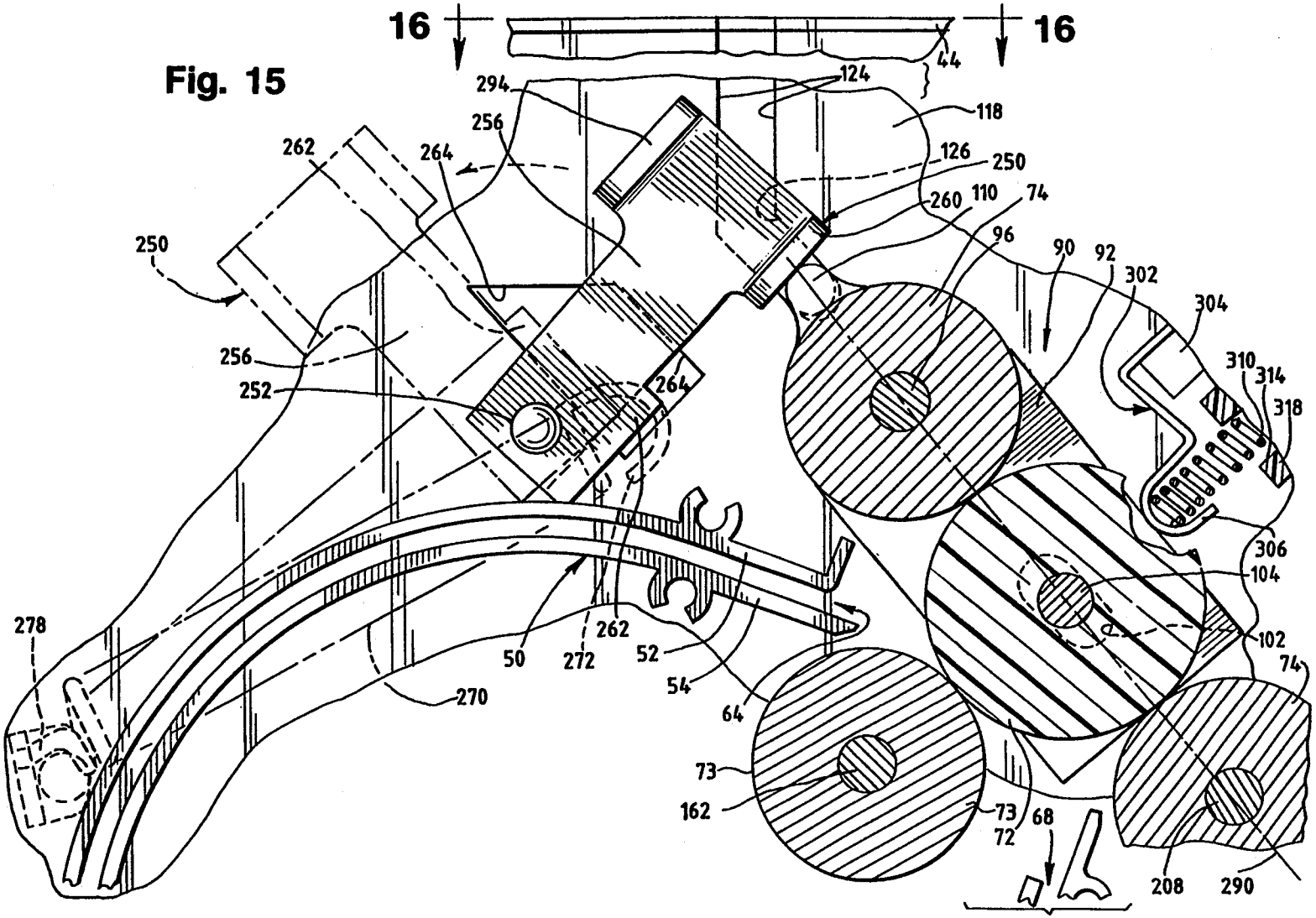
FIG. 15 is an enlarged, fragmentary, cross-sectional view taken generally along the plane 15—15 in FIG. 1.

When the dual cartridge assembly 90 is properly mounted within the machine as illustrated in FIG. 15, the assembly 90 lies at an angle relative to the horizontal top of the machine 30. The main roller 72 is positioned adjacent both the third roller 73 and fourth roller 74. The nip defined between the entrance pair rollers 71 and 72 is positioned generally below the feeder tray 32 for receiving the sheets 34.

The stack loading feeder tray 32 (FIG. 2) has a central slide deck 127 (FIG. 2) terminating along a bottom edge 129. The tray 32 includes a pair of laterally adjustable side guides 130. The tray 32 also includes a pair of downwardly projecting, outer side walls 132 which are pivotally mounted to a shaft 134.

The shaft 134 extends through the tray side walls 132 and is mounted at each end to the machine side walls 116 and 118. The mounting Of the tray side walls 132 on the shaft 134 accommodates pivoting of the tray 32 to an inoperative, storage position described in detail hereinafter.

Figures 2, 3, 4, 5:
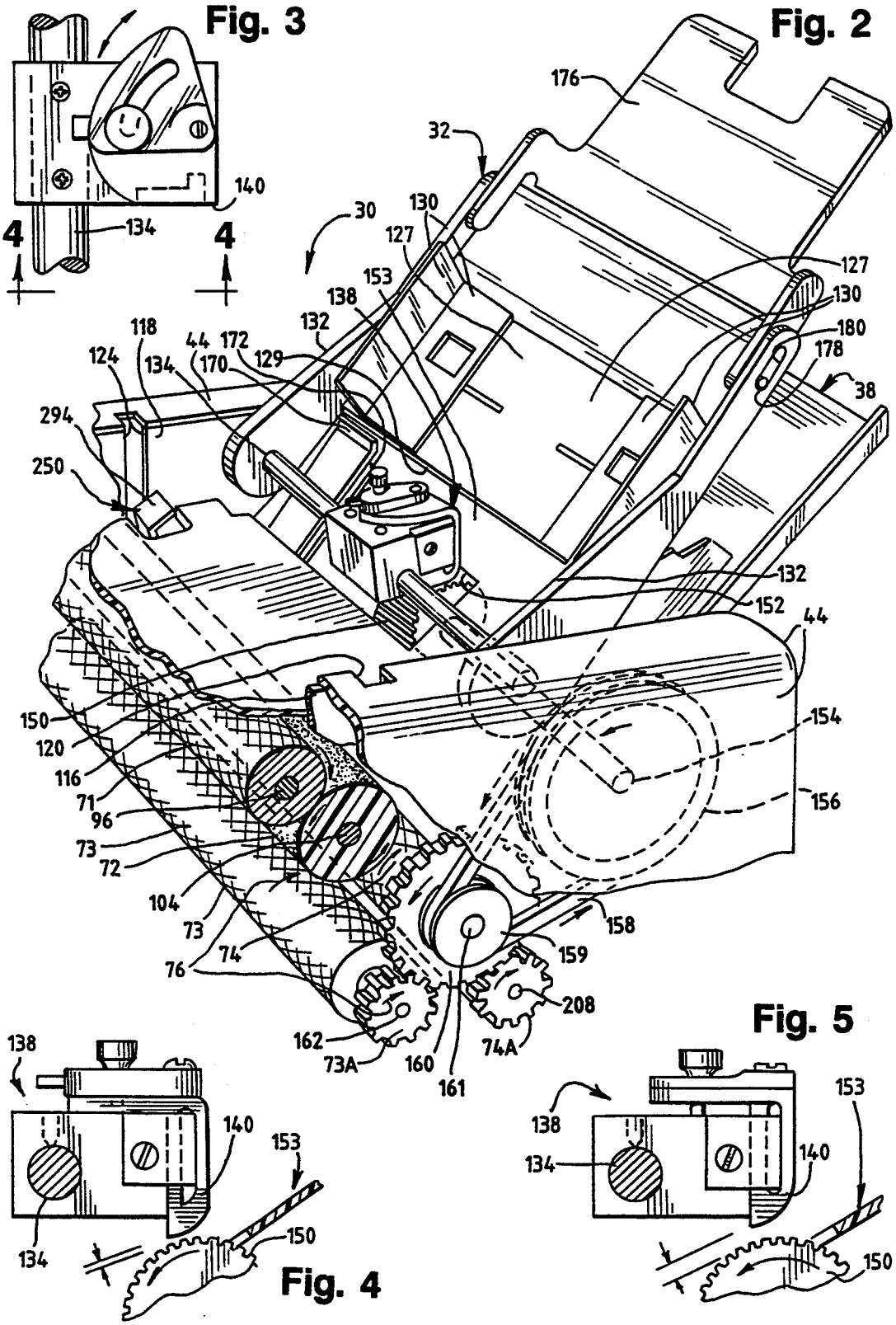
FIG. 2 is an enlarged, fragmentary, perspective view showing the sheet stack loading tray at the in-feed end of the machine.
FIG. 3 is an enlarged, fragmentary, top plan view of a portion of the machine shown in FIG. 2.
FIG. 4 is a fragmentary, cross-sectional view taken generally along the plane 4—4 in FIG. 3.
FIG. 5 is a view similar to FIG. 4, but showing portions of a component in a moved position.

The shaft 134 carries a conventional type of sheet stack retard assembly 138 which includes a vertically adjustable gate member 140 over a feed wheel 150. The gate 140 can be adjusted to provide a small clearance above the feed wheel 150 (FIG. 4). The gate 140 can also be raised as illustrated in FIG. 5 to provide more clearance above the feed wheel 150 to accommodate a thicker sheet or to accommodate a plurality of sheets (e.g., as in a letter having multiple pages stapled together). The assembly 138 may be of any suitable conventional or special design, the details of which form no part of the present invention.

The feed wheel 150 projects through a slot 152 (FIG. 2) in a fixed deck 153 below the feed tray 32 and is mounted on a shaft 154 supported mounted for rotation in the machine frame side walls 116 and 118. One end of the shaft 154 extends through the side wall 116 and which carries a drive pulley 156 (FIGS. 2 and 14). The pulley 156 is engaged with a drive belt 158 which is driven from a pulley 159 (FIG. 2) fixed to a gear 160. The gear 160 is mounted for rotation on a stub shaft 161 carried on, and projecting from, the wall 116. The stub shaft 161 dies not interfere with the cartridge 90 which carries the rollers 71 and 72.

The gear 160 is engaged with a gear 73A mounted to a shaft 162 on which the roller 73 is mounted. The shaft 162 extends between the machine frame side walls 116 and 118 and is rotated by a drive system described in detail hereinafter. The roller 73 and gear 73A rotate with the shaft 162, and the rotation of the gear 73A effects rotation of the gear 160. The gear 160 is also engaged with a gear 74A on a shaft 208 to which the roller 74 is mounted. The shaft 208 also extends between the machine frame side walls 116 and 118. The roller 74 is thus rotated when the shaft 208 rotates with the gear 74A as driven by the gear 73A through the gear 160.

As illustrated in FIG. 2, an inlet guide, comprising an upper guide member 170 and a lower guide member 172, is provided adjacent each side of the machine below the feed tray 32 (only one set of inlet guide members 170 and 172 is visible in FIG. 2 at the far side of the machine 30). The guide members 170 and 172 are spaced apart vertically to define an inlet channel for receiving the sheets fed by the roller 150. The sheets discharge from the channel at the bottoms of the guide members 170 and 172 and enter the nip defined by the entrance pair of rollers 71 and 72.

The upper, distal end of the feed tray 32 includes an extension plate 176 which is pivotally mounted on each side to the feed tray side walls 132 by means of outwardly projecting pivot pins 178 which are each received in an elongate slot 180 in the adjacent wall 132. When the tray 32 is not being used, the extension plate 176 can be pivoted forwardly 180° from the open position illustrated in FIG. 2 to a closed position in which the plate 176 nests within the tray 32. Then, the tray 32 can be pivoted forwardly about the shaft 134 to a horizontal orientation on top of, and generally parallel to, the cover plate 48 between the side walls of the machine.

Figure 6:
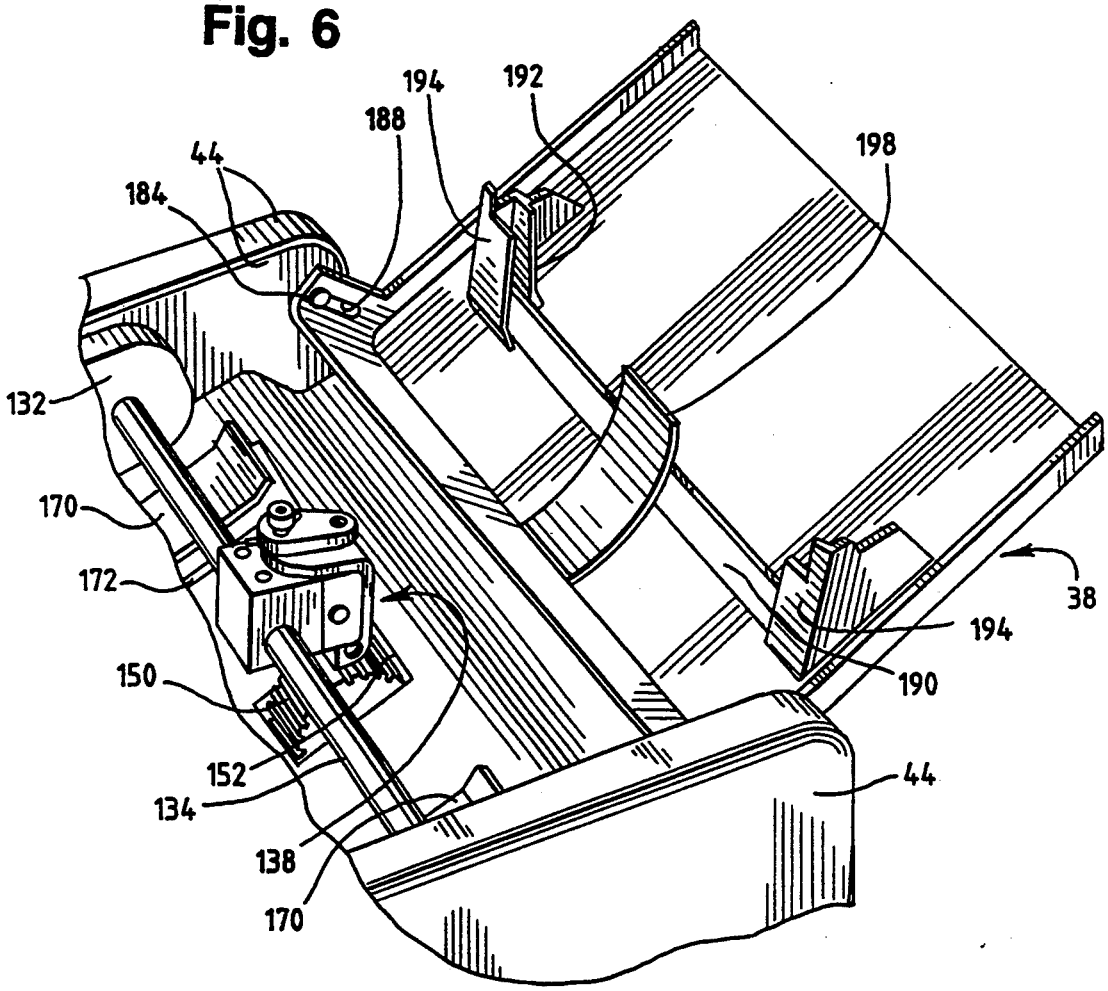
FIG. 6 is a view similar to FIG. 2, but showing the stack loading tray swung to an in operative, storage position.
Figure 7:
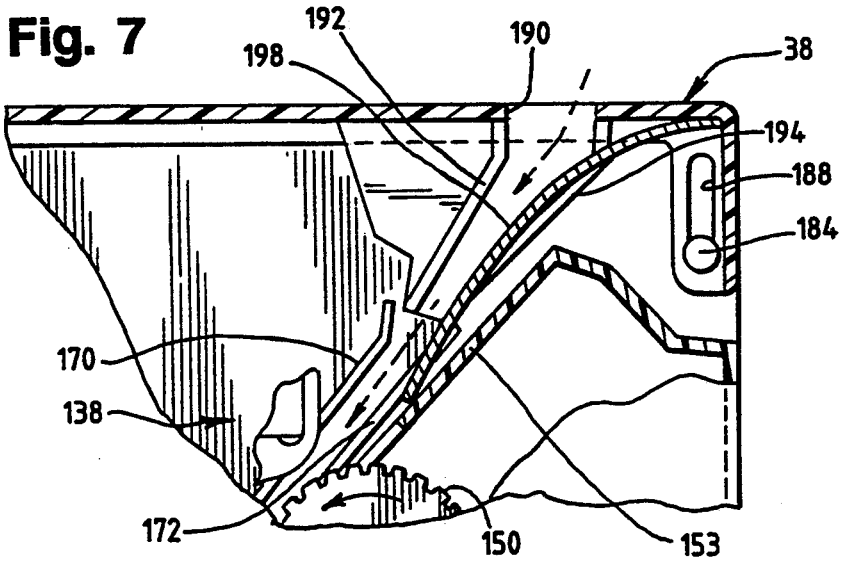
FIG. 7 is a fragmentary, cross-sectional view of the portion of the machine shown in FIG. 6 with the manual loading plate illustrated in the operative position.

When the tray 32 is folded over the machine cover plate 48 to the inoperative, storage position as described above, the manual sheet feeding plate 38 may be moved from the outwardly extended position (FIG. 6) to an inwardly pivoted, closed position (FIG. 7). This is accommodated by pins 184 on each side of the machine 30. Each pin 184 is received in an elongate slot 188 defined in a side of the tray 38. In the open, extended position illustrated in FIGS. 2 and 6, the tray 38 accommodates the outwardly pivoted, operating position of the stack loading feeder tray 34 (as shown in FIG. 2). However, when it is desired to use the manual sheet feeding plate 38, then the stack loading feeder tray 32 is folded closed as previously described, and then the feeding plate 38 is pivoted to the closed position illustrated in FIG. 7.

The manual sheet feeding plate 38 defines a slot 190 for receiving a single document (i.e., a single sheet or multiple sheets in registry). As can be seen in FIG. 6, the plate 38 includes a pair of spaced-apart guide walls 192 and 194 at each end of the slot 190 for guiding the document downwardly through the slot 190.

Further, the plate 38 includes an arcuate guide member 198 adjacent the center of the slot 190. As can be seen in FIG. 7, the arcuate guide member 198 guides the bottom of the document below the slot 190 into the space defined by the guide members 170 and 172. The document is then fed by the feed wheel 150 (FIG. 2) to the nip defined by the entrance pair of rollers 71 and 72 (FIGS. 14 and 15).

Figure 16:
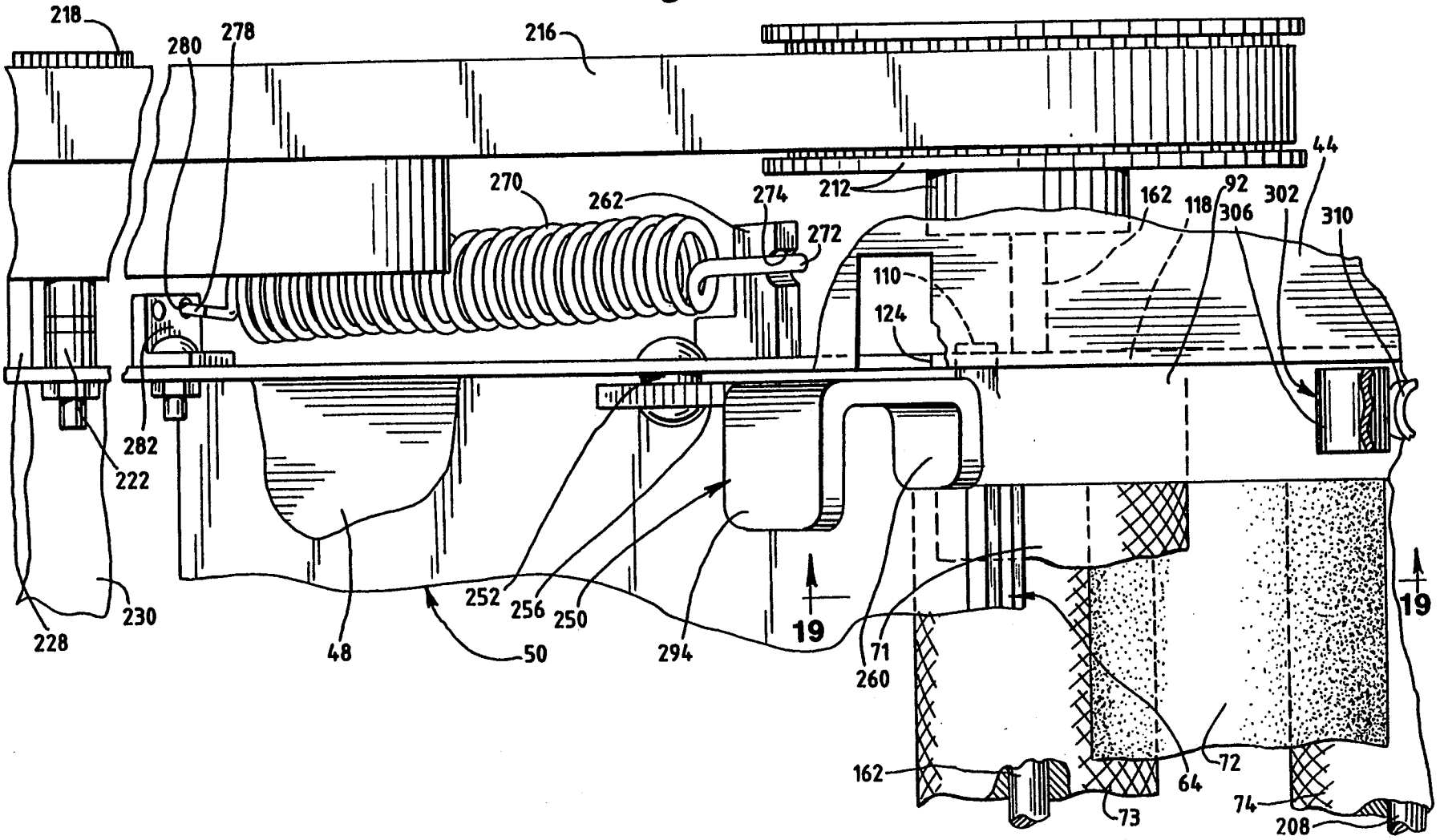
FIG. 16 is an enlarged, fragmentary, top plan view taken along the plane 16—16 in FIG. 15 with a portion of the upper housing broken away to illustrate interior detail.

Below the entrance pair of rollers 71 and 72, the third roller 73 and fourth roller 74 are mounted between the machine frame side members 116 and 118 on shafts 162 and 208, respectively, as previously described and as illustrated in FIGS. 14–16. The shaft 162 on which the third roller 73 is mounted carries the above-described gear 73A on one side of the machine (adjacent the outer side of the frame side wall 116) and carries a pulley 212 on the other side of the machine adjacent the outer side of the frame side wall 118 (as shown in solid lines in FIGS. 14 and 16).

The pulley 212 is of the conventional type for being driven by a toothed drive belt 216. The drive belt 216 is engaged with a smaller drive pulley 218 which is integral with a larger pulley 220 mounted for rotation about a shaft 222. The large pulley 220 is of the type that is engagable with a toothed belt 224 which is driven from a suitable drive sprocket 226 mounted on a drive shaft 228 of an electric motor 230. The motor 230 is mounted between the frame side walls 116 and 118, and the motor drive shaft 228 extends through the frame side wall 118 with the drive sprocket 226 mounted on the other side of the wall 118 below the pulleys 220 and 222.

Operation of the motor to rotate the drive sprocket 226 in the direction of the arrow 232 (FIG. 14) effects rotation of the driven third roller 73 in the direction of the arrow 236 (FIG. 14) which corresponds to the direction of rotation of the roller 73 as indicated by the arrow 76 in FIGS. 2 and 8. This rotates the gear 160 (FIG. 2) to rotate the roller 74 and sheet feed wheel 150 as previously described. The roller 72 is driven by frictional engagement with either or both rollers 73 and 74, and the roller 71 is driven by frictional engagement with roller 72.

In order to provide the proper engagement between the rollers of each pair and in order to accommodate the thickness of the sheet or sheets conveyed through the rollers, novel mechanisms are provided for maintaining the dual roller cartridge 90 in the machine 30. As illustrated in FIGS. 1, 2 and 14–16, a pair of first biasing clamps 250 are provided for engaging the upper surface of the stub shafts 110 on the holder end walls 92. One clamp 250 is adjacent the frame side wall 118 (FIGS. 2 and 16), and the other clamp 250 is adjacent the other frame side wall 116 (FIG. 1). The clamp 250 adjacent the wall 118 will next be described in detail with the understanding that the other clamp 250 has a mirror image configuration.

Each clamp 250 includes a rivet defining a pivot shaft 252 mounted to the frame side wall (e.g., wall 118 as shown in FIGS. 15 and 16). The clamp 250 also includes a lever 256 (FIG. 15) which is pivotally mounted at one end to the pivot shaft 252 and which defines an engaging tab 260 at the other end for engaging the holder stub shaft 110.

The lever 256 also defines a laterally extending tab 262 (FIG. 16) which projects through an aperture 264 in the frame side wall 118. A tension spring 270 has a hook portion 272 lying in a notch 274 (FIG. 16) defined in the upper edge of the tab 262 which extends outwardly from the clamp lever 256. The hook portion 272 extends over the top of the tab 262 to attach the upper end of the spring 270 to the clamp lever 256.

The bottom end of the tension spring 270 has a hook portion 278 (FIGS. 14 and 15) which is hooked through a bore 280 in a bracket 282 mounted to the frame side wall 118.

The mounting of the spring 270 between the bottom frame bracket 282 and the lever tab 262 relative to the lever pivot shaft 252 defines an over center toggle arrangement. As can be seen in FIGS. 14–16, when the clamp 250 is engaged with the cartridge holder stub shaft 110 (as illustrated in solid lines in FIGS. 15 and 16), a straight line defined by the connection points at each end of the spring 270 lies below the pivot shaft 252. In this orientation, the spring 270 exerts a continual biasing force against the stub shaft 110 and urges the cartridge 90 toward the fourth roller 74 (in a direction generally along an action line 290 (FIG. 15) defined by the centers of the first roller shaft 96 and second roller shaft 104).

The lever 256 can be moved to a self-maintained, release position to permit removal of the dual roller cartridge 90. To this end, the lever 256 includes a handle or finger grip tab 294 (FIGS. 15 and 16). The tab 294 can be lifted generally upwardly and rearwardly to pivot the lever 256 about the shaft 252 until the lever is in the full release position illustrated in phantom by dashed lines in FIG. 15. In the full release position, the line of action extending. between the end connections of the tension spring 270 is on the upper side of the pivot shaft 252, and the spring 270 thus continually biases the clamp 250 to the release position. The clamp 250 cannot pivot further than the release position illustrated in phantom in FIG. 15 because the laterally extending tab 262 which extends through the aperture 264 in the side wall 118 engages the side wall 118 along the angled, rear edge of the aperture 264.

The lever 256 and spring 270 define a bistable, over center toggle arrangement such that the spring 270 exerts a maximum spring tension when the lever 256 is moved from either the clamping position or the full release position to an intermediate, over center position where the pivot shaft 252 lies on the straight line defined by the spring end connections. In that orientation, the system is unstable, and a small movement in either direction will result in the lever 256 being carried to the end of the range of movement in that direction and being held there by the action of the spring 270. The above-described design and operation of the clamp 250 adjacent the wall 118 also applies to the other clamp 250 adjacent the wall 116 (FIG. 1).

The dual roller cartridge 90 is also engaged with a second clamping force to urge the cartridge 90 against the third roller 73. To this end, each side of the machine includes a second clamp in the form of a resilient metal arm 302 mounted to a shoulder 304 projecting inwardly from the frame side wall (e.g., wall 118 as illustrated in FIG. 15). The resilient metal arm 302 includes an arcuate engaging surface 306 for engaging one of the end walls 92 of the dual roller cartridge 90. A helical coil compression spring 310 is mounted with a lower end engaged with the spring arm 302 and with the other end retained within a bore 314 of a socket 318 mounted to the frame side wall 118. Thus, the spring arm 302 is biased outwardly so that the spring arm arcuate surface 306 bears against the cartridge end wall 92 to urge the end wall 92 toward the third roller 73. Although not visible in the Figures, the other frame side wall 116 includes a similar spring arm assembly for engaging the other end wall 92 of the dual roller cartridge 90.

The dual roller cartridge 90 accommodates movement toward the third roller 73 under the influence of the spring arms 302 because the cartridge stub shafts 110 at each end are pivotally received in the frame side wall slots (slot 126 in side wall 118 and slot 122 in side wall 116). This accommodates pivoting movement of the cartridge 90 about the axis defined by the stub shafts 110.

In a presently contemplated preferred commercial form of the machine 30, the design of the cartridge clamp spring system can be simplified. In particular, by employing a sufficiently stiff spring arm 302, the compression spring 310 and receiving wall 318 can be eliminated.

Figure 19:
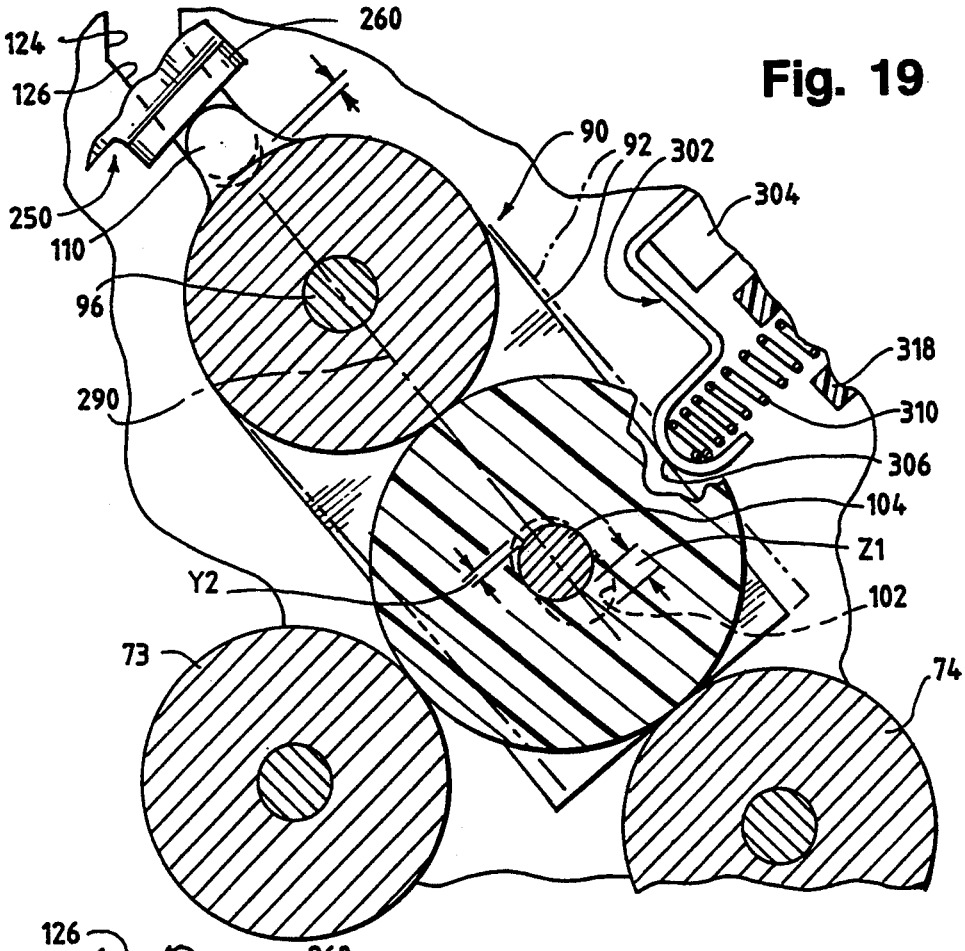
FIG. 19 is a fragmentary, cross-sectional view taken generally along the plane 19—19 in FIG. 16.

FIGS. 19–22 illustrate how the dual roller cartridge clamping system of the present invention maintains proper roller pressure, and also accommodates the varying thickness of a sheet or sheets while still permitting the cartridge 90 to be quickly and easily removed from the machine 30. In particular, when the cartridge 90 is properly installed for receiving sheets as illustrated in FIG. 19, the second roller 72 is held tightly against both the third roller 73 and the fourth roller 74, as well as against the first roller 71. The proper initial contact among the rollers is accommodated by providing certain clearances. Specifically, the cartridge stub shafts 110 do not seat against the bottom end of the receiving slots (e.g., slot 126 in wall 118 as shown in FIG. 19). FIG. 19 shows a clearance X1 between the bottom end of the slot 126 and the stub shaft 110.

Additionally, the shaft 104 of the second roller 72 is unrestrained in the directions along the line 290 which passes through the center of the second roller shaft 104 and the center of the first roller shaft 96. More particularly, as illustrated in FIG. 19, there is a clearance Y1 between the second roller shaft 104 and the upper end of the slot 102 in the cartridge end wall 92, and there is a clearance Z1 between the second roller shaft 104 and the bottom end of the slot 102.

In view of the clearances X1, Y1 and Z1, it will be appreciated that the initial position of the cartridge 90 is not determined solely by the machine frame mounting slots (slot 126 in FIG. 19 and slot 122 in FIG. 1). Rather, the second, main roller 72 moves as necessary in the slots of the cartridge 90 to engage the lower roller 74 on one side and to engage the upper roller 71 on the other side. This engagement is maintained by the first biasing clamp 250. However, it will be realized that because of the clearances X1, Y1 and Z1, relative movement can occur between the main roller 72 and each of the other rollers if the downward force of the biasing clamp 250 is overcome to permit displacement of the cartridge 90 upwardly along the frame slots (126 in FIG. 19 and 122 in FIG. 1) as described in detail hereinafter.

The dual roller cartridge 90 can also pivot about the cartridge stub shafts 110 against the biasing force of the spring arm 302. FIG. 19 illustrates the initial, assembled position of the cartridge 90 in solid lines and illustrates a pivoted position in phantom with dashed lines. The cartridge 90 can be pivoted in the direction away from the third roller 73 to overcome the biasing force of the spring 310 during operation of the machine as described in detail hereinafter.

Figure 20:
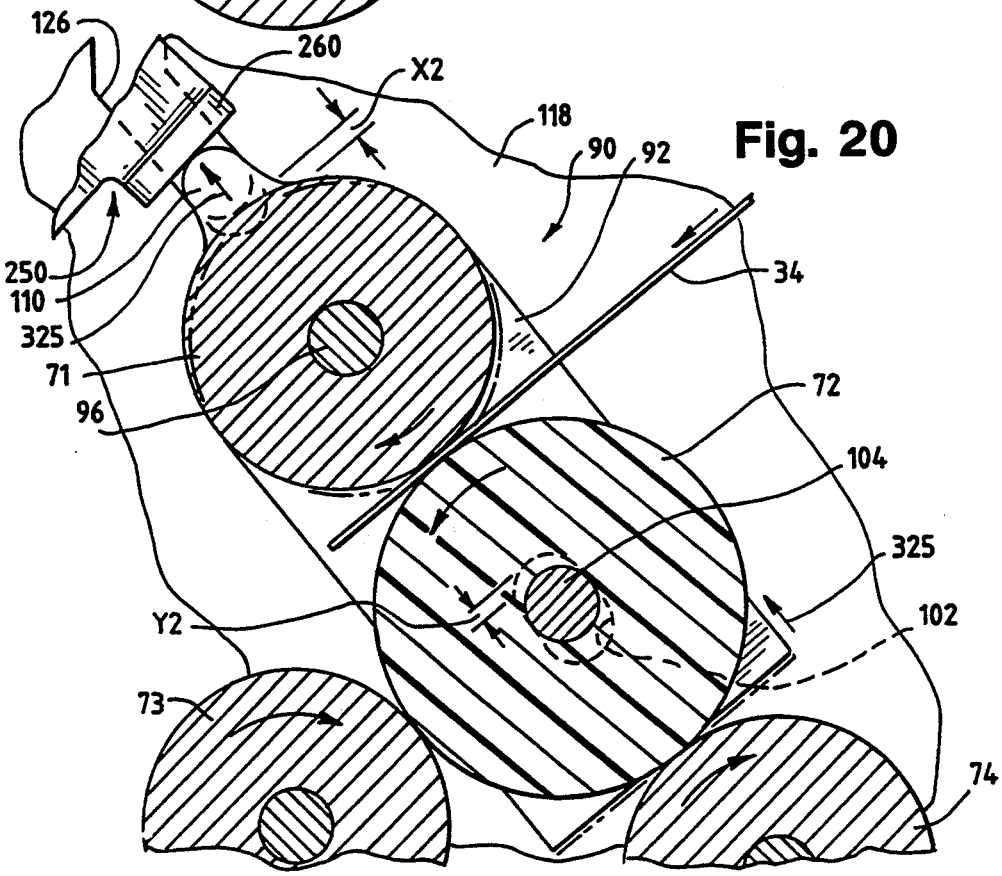
FIGS. 20–22 are views similar to FIG. 19 showing the sequential operation of the apparatus as a paper sheet is conveyed through the rollers.

FIG. 20 illustrates the initial entry of a sheet 34 into the nip defined by the entrance pair of rollers 71 and 72. The rollers 71 and 72 must accommodate the thickness of the sheet 34. Thus, relative movement must occur between the rollers 71 and 72 to increase the distance between the shaft 96 of the first roller 71 and the shaft 104 of the second roller 72. To this end, when the sheet 34 enters the nip of the rollers 71 and 72, the first roller 71 is moved upwardly, but the main roller 72 is prevented from moving downwardly by the fixed rollers 74 and 73. The first roller 71 moves upwardly because the roller shaft 96 is carried in the cartridge holder end walls 92, and the cartridge 90 moves upwardly as the cartridge holder stub shafts 110 push against the clamps 250. The clamps 250 are pivoted upwardly a slight amount against the biasing force of the tension springs 270 (FIGS. 1, 15 and 16) by each upwardly moving stub shaft 110 in the side frame slots (e.g., slot 126 in frame side wall 118 as shown in FIG. 20). Thus, with reference to FIG. 20, the space between the bottom of the frame side wall slot 126 and the stub shaft 110 increases to a clearance distance X2 compared with the initial, smaller clearance distance X1 shown in FIG. 19.

Because the cartridge holder end walls 92 are moved outwardly in the direction of the arrow 325 as illustrated in FIG. 20, each end wall slot 102 moves outwardly relative to the main roller shaft 104 to define an increased clearance distance Y2 between the upper end of the slot 102 and the shaft 104. The main roller 72 remains in contact with the lower roller 74, however, owing to the downward biasing force of the clamp 250 which is transmitted through the stub shaft 110, end wall 92, first roller shaft 96, first roller 71, and sheet 34 to the main roller 72.

Figure 21:
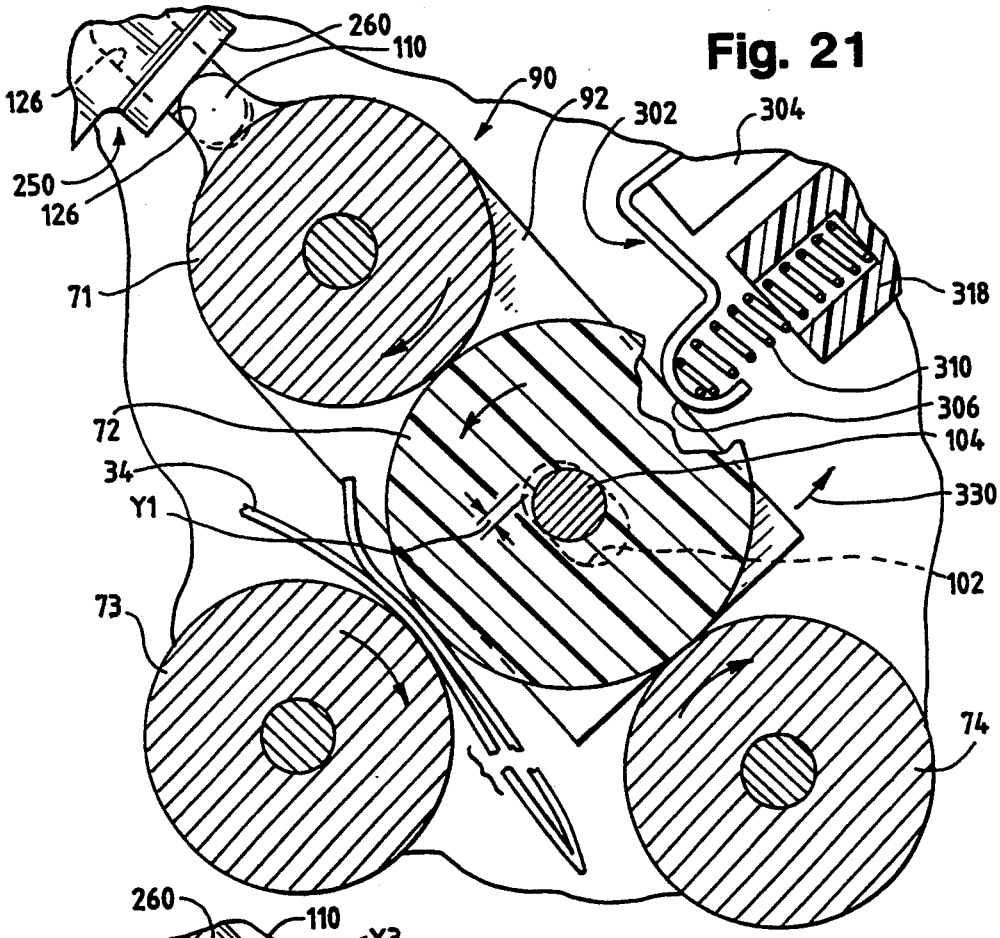

As explained previously in detail with reference to FIGS. 9, 10, and 11, the sheet 34 is buckled to form a first fold, and the folded sheet then passes between the nip of the main roller 72 and third roller 73 as illustrated in FIG. 21. The single folded sheet 34 presents a double-sheet thickness which must be accommodated between the rollers 72 and 73. To this end, the cartridge 90 pivots about the axis of the stub shafts 110 outwardly so as to swing the main roller 72 away from the fixed, third roller 73 in the direction of the arrow 330 in FIG. 21. The springs 310 compress somewhat to accommodate the necessary separation between the main roller 72 and the fixed, third roller 73.

Figure 22:
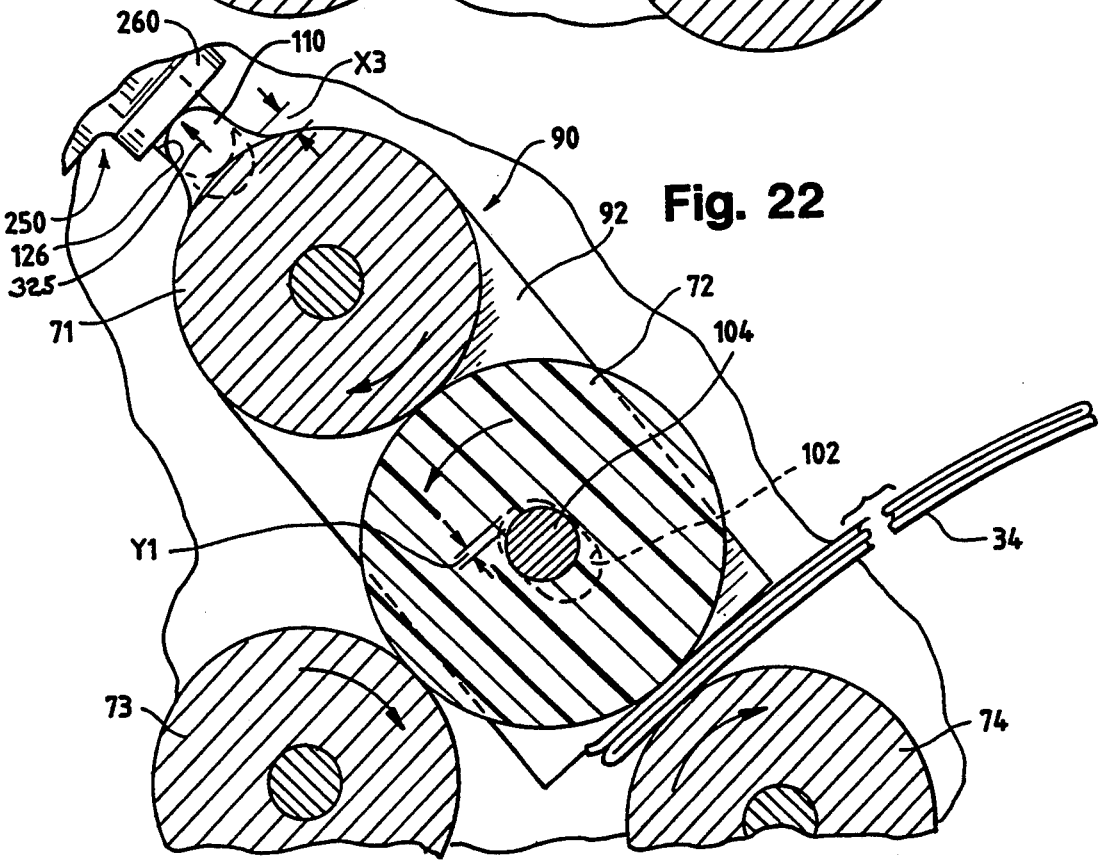

As explained previously with reference to FIGS. 11–13, the sheet 34 is folded a second time as it passes through the nip of the rollers 72 and 74. FIG. 22 illustrates the movement of the main roller 72 away from the fixed, fourth roller 74 to provide the necessary clearance to accommodate the double-folded sheet 34. Because the main roller 72 is already in contact with the first roller 71, the main roller 72 cannot move away from the fixed roller 74 unless the first roller 71 also moves outwardly along with the entire cartridge 90 in which the roller 71 is mounted. This is accommodated by overcoming the biasing force of the clamps 250 as the cartridge stub shafts 110 move upwardly in the slots 122 and 126. Thus, as shown in FIG. 22, the clearance distance between end of the slot 126 and the stub shaft 110 is increased to a distance X3.

The above-described dual roller cartridge 90 and mounting system therefor provides an effective arrangement for maintaining proper roller engagement and roller pressure on the sheet 34 conveyed through the rollers. The unique structure permits displacement of the selected rollers as necessary to accommodate various thicknesses of the sheet 34 as the sheet is folded. Additionally, the arrangement can accommodate increased thicknesses of multiple sheet documents.

Further, if access to the rollers is required, the clamps 250 can be easily moved to the release position (as in shown in phantom in FIG. 15) to permit removal of the dual roller cartridge 90. This facilitates cleaning of the rollers, replacement of the rollers, and clearing of a jammed sheet from between the rollers.

The design permits the complete removal of the entrance roller pair cartridge by an ordinary office worker in a simple and quick manner without the use of tools.

The sheet feeding system which is defined by the entrance roller pair cartridge 90 and the mounting system therefor can be easily accommodated in a relatively small, table-top machine for use on an office desk or table. Also, the system may be incorporated in other paper-handling office machines, such as xerographic machines.

Although the preferred embodiment of the invention has been described with reference to an entrance roller pair, it will be appreciated that the invention may be employed in the mounting of an exit roller pair. That is, the fourth, exit roller 74 may be mounted in a suitable, removable holder or cartridge along with the main roller 72 in a manner analogous to the above-described mounting of the main roller 72 and entrance roller 71 in the cartridge 90. In that case, the machine 30 could be designed to provide suitable clearance for access on the underside of the machine.

Alternatively, the machine chute assembly could be modified so that the location of the entrance roller 71 can be interchanged with the location of the exit roller 74 and so that the location of the assembly of the feed tray 32 and feed plate 38 can be interchanged with the location of the exit tray 40. This would permit a cartridge holding the exit roller 74 and main roller 72 to be easily removed from the top of the machine.

For some commercial applications, it is presently contemplated that the design of a preferred form of the machine 30 would be simplified. In particular, the manual sheet feeding plate 38 (FIG. 1) is eliminated. The stack loading tray 32 is then reconfigured somewhat, and is used exclusively for feeding single or stacked, multiple sheets. However, the details of such a preferred, alternate form of the machine sheet loading tray system form no part of the present invention.

It will be readily apparent from the foregoing detailed description of the invention and from the illustrations thereof that numerous variations and modifications may be effected without departing from the true spirit and scope of the novel concepts or principles of this invention.

What is claimed is:

1. A sheet feeding system for use in a buckle-type sheet folding apparatus having sheet-receiving chutes and rollers for folding a sheet, said sheet feeding system comprising:
   - a frame in which said sheet-receiving chutes are disposed and in which two of said rollers are rotatably mounted in parallel adjacent said chutes;
   - a roller holder removably mounted in said frame; and
   - a main roller and a coacting roller rotatably mounted in said holder parallel to said two rollers to define three roller pairs each presenting a nip through which said sheet is fed, said holder being readily removable to accommodate replacement with a new holder.

2. The sheet feeding system in accordance with claim 1 in which
   - said coacting roller is an entrance roller; and
   - said main roller and said holder are relatively movable along a plane defined by the axes of rotation of said entrance roller and said main roller.

3. The sheet feeding system in accordance with claim 1 further including
   - a first biasing clamp engaging said holder to urge said main roller against one of said two rollers; and
   - a second biasing clamp engaging said holder to urge said main roller against the other of said two rollers.

4. The sheet feeding system in accordance with claim 1 in which said frame includes a pair of spaced apart side walls;

each said side wall defines a slot facing the other side wall and open at the top of the frame; and said holder defines a pair of oppositely extending stub shafts adapted to be received in one of said frame side wall slots.

5. The sheet feeding system in accordance with claim 1 in which said holder includes two spaced-apart end walls;

said coacting roller and main roller each include a central shaft projecting outwardly at each end;

each said end wall of said holder defines a bore axially aligned with the other bore;

each end of said coacting roller shaft is received in one of said bores to define an axis of rotation fixed relative to said holder;

each said end wall of said holder defines an elongate slot aligned with the other elongate slot; and each end of said main roller shaft is received in one of said slots to accommodate relative movement between said main roller and said coacting roller.

6. A sheet feeding system for use in a buckle-type sheet folding apparatus in which said sheet is conveyed by first, second, third, and fourth parallel rollers disposed with said first and second rollers arranged as a coacting first pair to define an intake nip, with said second and third rollers arranged as a coacting second pair to define a first fold nip, and with said second and fourth rollers arranged as a coacting third pair to define a second fold nip; and in which first and second chutes each sequentially receive portions of said sheet and block further conveying of said sheet in one direction to buckle said sheet sequentially into said first fold nip and second fold nip; said feeding system comprising:

a frame in which said pockets are disposed and in which said third and fourth rollers are rotatably mounted in parallel;

a roller holder removably mounted in said frame; said first and second rollers being rotatably mounted in said holder with said holder and said second roller being also relatively movable to increase and decrease the distance between said first and second rollers;

a first biasing clamp engaging said holder to urge said first roller against said second roller and urge said second roller against said fourth roller; and a second biasing clamp engaging said holder to urge said second roller against said third roller.

7. The sheet feeding system in accordance with claim 6 in which said second roller is a central roller;

said first roller is an upper roller;

said third roller is a side roller; and said fourth roller is a lower roller.

8. The sheet feeding system in accordance with claim 6 in which said first biasing clamp includes (a) a pivot shaft on said frame defining a pivot axis;

(b) a lever pivotally mounted to said frame with said shaft, said lever having a distal portion and having an intermediate portion between said pivot shaft and said distal end portion, said lever being movable about said pivot axis to move said distal end portion into and out of engagement with said holder; and (c) a tension spring connected at one end to said frame and at the other end to said lever intermediate portion so that when said spring end connections lie on a straight line intersecting said pivot axis the spring is under maximum extension to define a bistable over center position on either side of which the spring length decreases and said lever is urged to a stable position at the end of its travel range on that side of the over center position.

9. The sheet feeding system in accordance with claim 6 in which said second biasing clamp includes a resilient metal arm attached to said frame and a compression spring acting between said arm and said frame for forcing said arm against said holder and urging said second roller toward said third roller.

10. The sheet feeding system in accordance with claim 6 in which said frame includes a pair of spaced apart side walls;

each said side wall defines a slot that faces the other side wall and that is open at the top of the frame; and said holder defines a pair of oppositely extending stub shafts each adapted to be received in one of said frame side wall slots.

11. The sheet feeding system in accordance with claim 10 in which each said slot has an upper portion and a lower portion extending at an oblique angle relative to said upper portion.

12. A sheet feeding system for use in a buckle-type sheet folding apparatus having sheet receiving chutes and rollers for folding a sheet, said sheet feeding system comprising:

a frame in which said sheet-receiving chutes are disposed and in which two of said rollers are rotatably mounted in parallel adjacent said chutes;

a roller holder pivotally mounted in said frame for swinging movement about an axis parallel to said two rollers;

an entrance roller and a coacting main roller rotatably mounted in said holder parallel to said holder pivot axis to define an intake nip, said entrance roller being rotatable about an axis fixed relative to said holder, said main roller having a shaft defining an axis of rotation, said main roller shaft being mounted in slots defined in said holder to accommodate relative movement between said holder and said main roller whereby the distance between said entrance roller and main roller can vary;

a first biasing clamp engaging said holder to urge said main roller against one of said two rollers; and a second biasing clamp engaging said holder to urge said main roller against the other of said two rollers.

* * * * *